United States Patent [19]

Matsumoto et al.

[11] 3,945,222

[45] Mar. 23, 1976

[54] APPARATUS FOR SETTING A PATTERN TO A PATTERN WHEEL IN A CIRCULAR KNITTING MACHINE

[75] Inventors: Fukuo Matsumoto; Kikuo Kondo; Masao Shibata, all of Aichi, Japan

[73] Assignee: Toray Textiles, Inc., Tokyo, Japan

[22] Filed: Dec. 3, 1973

[21] Appl. No.: 421,141

[30] Foreign Application Priority Data

Dec. 29, 1972 Japan ..... 48-1126

[52] U.S. Cl. ..... 66/1 R; 66/50 A

[51] Int. Cl.[2] ..... D04B 37/04

[58] Field of Search ..... 66/50 A, 1 R, 154 A

[56] References Cited

UNITED STATES PATENTS

| | | | |
|---|---|---|---|
| 2,240,421 | 4/1941 | Shelmire | 66/50 A |
| 2,990,702 | 7/1961 | Schmidt | 66/50 A X |
| 3,059,843 | 10/1962 | Corbaz | 66/1 R |
| 3,076,325 | 2/1963 | Schmidt | 66/50 A |
| 3,313,128 | 4/1967 | Schmidt et al. | 66/50 A |
| 3,313,129 | 4/1967 | Stock | 66/50 A X |

FOREIGN PATENTS OR APPLICATIONS

| | | | |
|---|---|---|---|
| 87,538 | 7/1966 | France | 66/50 A |
| 1,401,262 | 4/1965 | France | 66/50 A |
| 438,387 | 12/1926 | Germany | 66/50 A |
| 6,504,245 | 10/1965 | Netherlands | 66/50 A |

OTHER PUBLICATIONS

Gross, Knitting Times, Dec. 4, 1972, Vol. 41, No. 50, pp. 92 and 93.

*Primary Examiner*—Wm. Carter Reynolds

[57] ABSTRACT

A pattern for a pattern wheel used in a circular knitting machine is set by detecting a blade of the pattern wheel to actuate a tape reader which has been patterned in advance, and pushing a jack of the pattern wheel in response to the signal from said tape reader.

7 Claims, 4 Drawing Figures

APPARATUS FOR SETTING A PATTERN TO A PATTERN WHEEL IN A CIRCULAR KNITTING MACHINE

The present invention relates to an apparatus for setting a pattern for a pattern wheel in a circular knitting machine, which comprises automatically setting an indicated pattern by pushing jacks of the pattern wheel.

Heretofore, it has been known generally to set a pattern by manually pushing a jack of a pattern wheel and by visual observation of an indicated pattern by the naked eye of the worker, and by using a special tool.

However, this manual pattern setting is operationally inefficient. Moreover, operators tend to make mistakes.

The art has also developed an apparatus for setting a pattern to a pattern wheel, which comprises a key arranged to rotate a fixed pattern wheel, and another key arranged to push a jack of the pattern wheel. Means are provided for operating these keys alternately to set the pattern. This apparatus has been found more efficient than manual pattern setting, but the tendency to make mistakes still remains.

Another known apparatus for setting a pattern to a pattern wheel includes a means for rotating the pattern wheel stepwise through a fixed angle of 360° divided by the number of jacks, using a pulse motor, and, at the same time, causing the stepwise rotation of this pattern wheel to stop temporarily at the location pressing device for pushing a jack directly connected to a solenoid adjacent thereto on the circumference of the pattern wheel, causing the solenoid to be actuated by an electric signal from a tape reader to actuate the presser which is directly connected to the solenoid and arranged to push the jack of the pattern wheel.

The latter apparatus is much more efficient than the others referred to. However, because this apparatus automatically sets a pattern, it has the following drawbacks. Because the pattern wheel rotates stepwise at a predetermined fixed angle, when the blades are bent or the spaces between the blades are lacking in uniformity, the jack is not precisely pushed, but the blades are pushed or touched, an erroneous action is carried out and the resulting pattern is defective.

In order to prevent such erroneous action, devices have been provided which give warning and stop further motion. However, the apparatus accordingly stops whenever there is a difference in blade spacings, and this procedure has accordingly been very inefficient.

Again, the pattern wheel differs with respect to spaces between the jacks in different kinds of knitting machines, and in the number of gauges. Accordingly, the pattern setting device must have an indexing mechanism which is adaptable to the number of kinds of pattern wheels, or to the number of pattern setting devices, with the result that the apparatus becomes complicated and expensive.

The strongest reason for this drawback resides in the necessity for rotating the pattern wheel through a fixed angle of rotation, which is a characteristic of this pattern setting apparatus.

In order to overcome the foregoing drawbacks wherein a pattern wheel is rotated through a fixed angle of rotation, the pattern which is indicated in advance by an electric operation is detected and actuated and jacks are pushed by a presser, the present invention provides a means for detecting the presence of the blades.

The present invention relates to an apparatus for setting a pattern to a pattern wheel in a circular knitting machine which comprises means for supporting a pattern wheel with a detecting means adjacent to the pattern wheel, means for driving a tape reader in response to an electric circuit signal generated by the detecting means, means emitting an electric signal for reading a pattern which has been set in advance to actuate a member for pushing jacks of the pattern wheel, and means for pushing the jacks of the pattern wheel.

DRAWINGS

Figure 1:
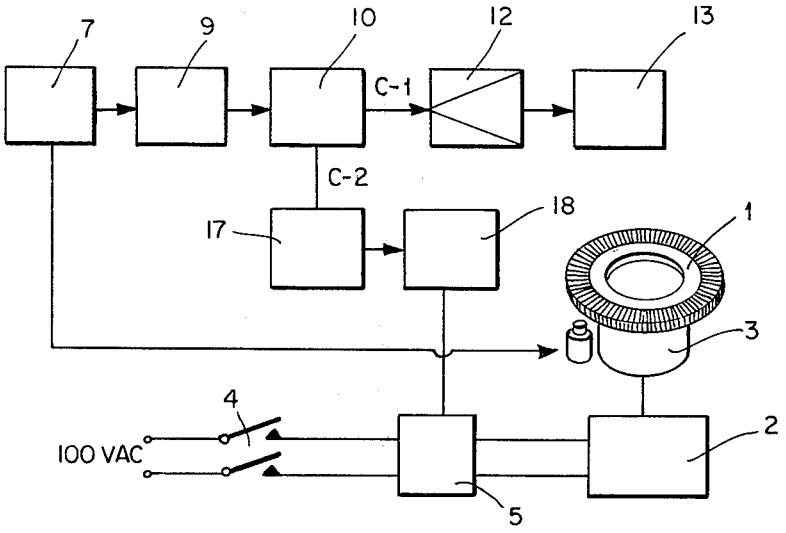
FIG. 1 is a block diagram of an electrical system in an apparatus comprising one embodiment of the present invention.
Figure 4:
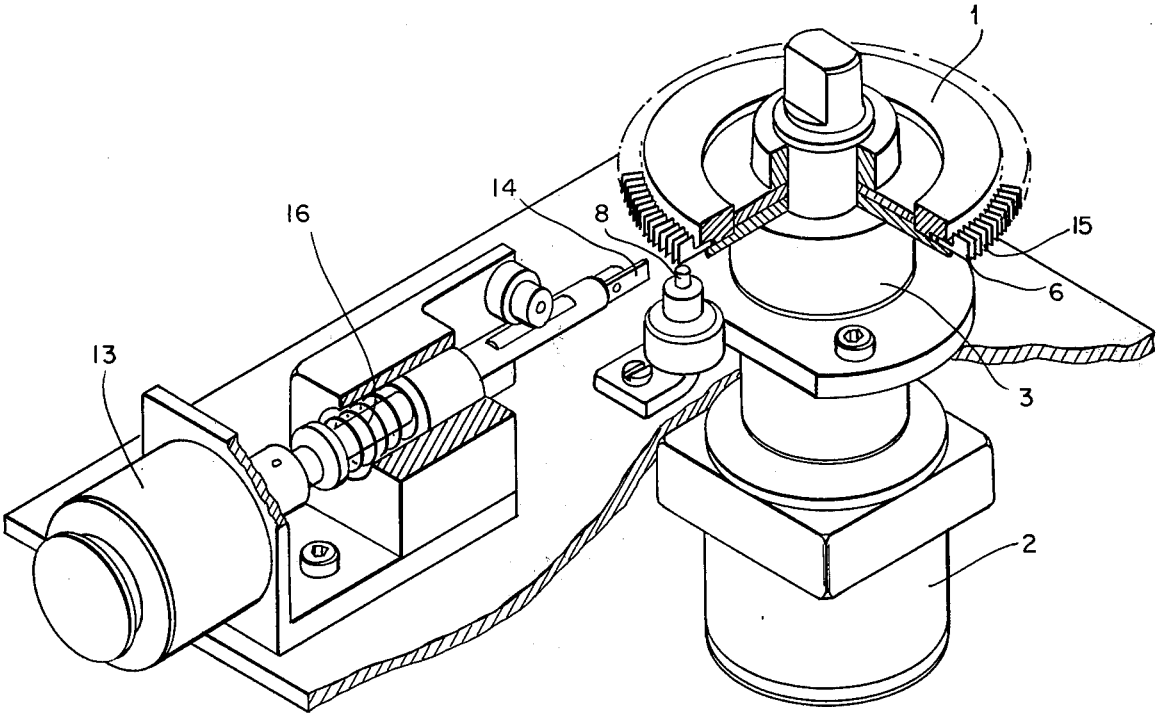
FIG. 4 is a view in perspective showing a mechanism for rotating a pattern wheel and the relationship between the presser for pushing the jacks and the blade detecting section in the apparatus.
Figure 2:
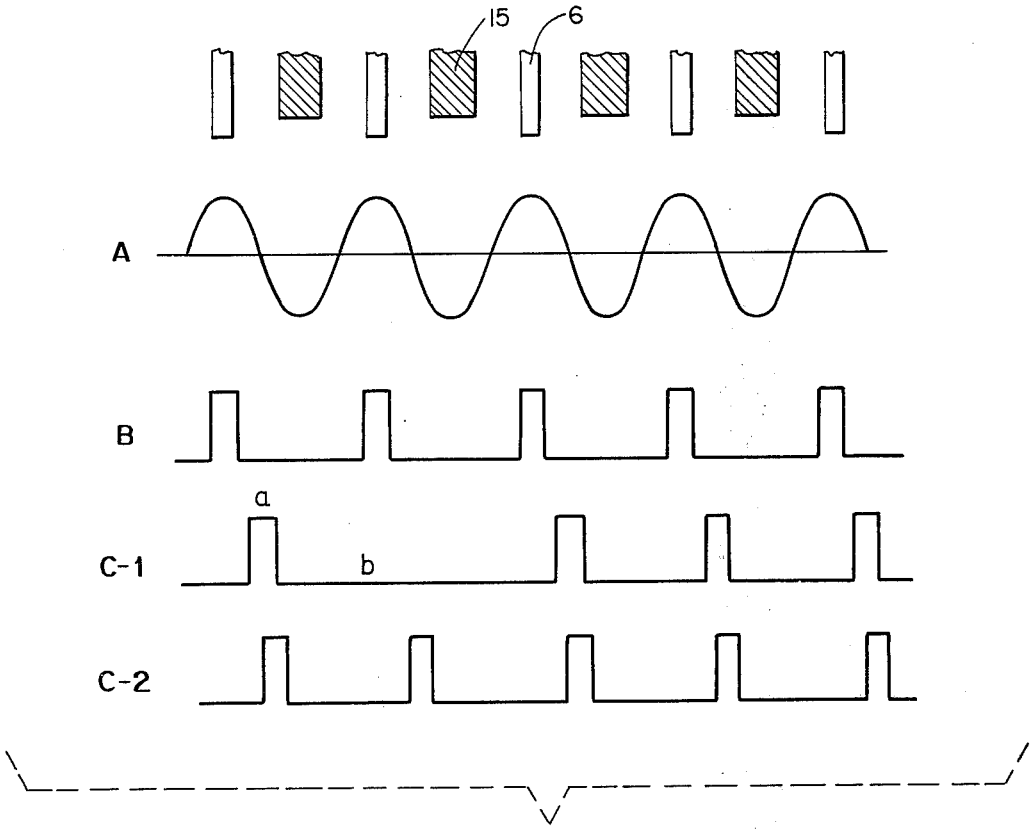
FIG. 2 shows the wave shapes of electrical signals at various parts of the apparatus of FIG. 1 and a fragmentary diagram of the spatial relations of the blades and jacks.
Figure 3:
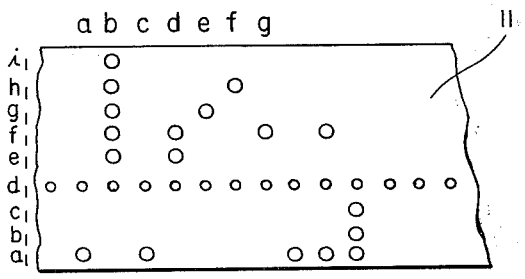
FIG. 3 is a sketch showing a typical punched paper tape adapted to be fed into a tape reader.

In FIGS. 1 and 4, a pattern wheel 1 for setting a pattern is placed on a disc 3 directly connected to a motor 2. The pattern wheel, as will be apparent, is a part of a circular knitting machine and is connected in a manner well known in the art to control the operation of the working parts of the knitting machine. When a starting switch 4 is turned on, an electric current runs the motor 2 via a relay 5. At the same time, the pattern wheel starts to rotate. Referring to FIG. 4, the pattern wheel 1 has a series of outwardly projecting spaced radial blades 6 constituting pattern wheel walls between which radial jacks 15 are confined, as more clearly shown in FIG. 2. A pick-up head 8 of a high-frequency proximity switch 7 is provided close to and under a blade 6 of the pattern. Whenever the motor 2 rotates, and the blade 6 of the pattern wheel passes over the pick-up head 8, an alternating current voltage as shown at A in FIG. 2 is generated as an output of the high-frequency proximity switch 7. The voltage A is shaped in a wave form shaping circuit 9 in FIG. 1 into a rectangular wave pulse voltage B in FIG. 2, which is added as a driving pulse to a tape reader 10, forwarding a paper tape 11 as shown in FIG. 3 set with said tape reader 10 by one character per single pulse B.

Accordingly, when one blade 6 passes the pick-up head 8, one pulse B is generated, the paper tape 11 (FIG. 3) of the tape reader 10 advances by one character. When there is a hole in the paper tape 11 at this time, the output of the tape reader 10 becomes as indicated at C-1(*a*) in FIG. 2, and a pulse voltage is generated. This voltage is amplified by an amplifier 12 and then applied to a solenoid 13.

When the solenoid 13 is thus actuated as shown in FIG. 4, a presser 14 of which the solenoid 13 is the driving portion, is actuated to push jack 15 in. When the voltage applied to the solenoid 13 runs out, the solenoid is deenergized and presser 14 is returned to its original position by a spring 16 which constitutes a member for bringing back the driving portion 13; The sequence of operation of the presser 14 is such that a respective jack 15 is pushed in just after the time when the immediately adjacent leading blade is detected by the pick-up head 8 of the proximity switch 7, and the presser 14 is then returned by the spring 16 to its original position before the time when the next successive blade is detected by the proximity switch.

Whenever one blade 6 passes the detecting station, the paper tape 11 of the tape reader 10 is advanced by one character. The sprocket holes of the paper tape are read by the tape reader 10, generating pulse voltages as shown as C-2 in FIG. 2. This voltage is amplified by another amplifier 17 to actuate a counter 18.

Accordingly, when the detector is so set that whenever a blade portion passes by an amount corresponding to the number of total jacks of the pattern wheel 1, a point of contact of said counter is created, when the pattern wheel 1 makes one round, the point of contact of said counter actuates a relay 5, opening the circuit which provides power to the motor 2, and stopping rotation of the motor 2 to complete the setting of the pattern of the pattern wheel.

FIG. 3 shows one example of the punched paper tape, wherein the line $d_1$ shows the sprocket holes, from which the signal for the counter 17 is taken, while lines $(a_1) - (c_1)$ and $(e_1) - (i_1)$ are used for emitting the signals for pushing jack 15 of the pattern wheel 1.

For example, holes are provided in a row of the $(a_1)$ line. Therefore, when the tape reader 10 reads them at a position passing the blade 6, a pulse voltage is generated as shown by C-1 in FIG. 2, the solenoid 13 opens, the jack 15 is pushed by the presser 14, to the inside of the pattern wheel 1.

When the pattern wheel 1 further rotates as driven by the motor 2 to pass the next blade, the tape reader 10 advances the paper tape 11 by one character and transfers to line $(b)$ of the paper tape 11, where there is no hole, therefore, the jack 15 is not pushed in because the presser 14 does not operate.

Accordingly, the jack 15 of the pattern wheel 1 is either pushed or not pushed by the presser 14, depending upon the punched pattern on the paper tape 11, and the pattern is applied to the pattern wheel 1.

In the above embodiment, the pattern wheel 1 is rotated by the motor 2, the blade 6 of the pattern wheel 1 is detected by the pick-up head 8 of the high-frequency proximity switch 7, the tape reader 10 is driven and the jack 15 of the pattern wheel is actuated by a signal from the tape reader 10 which has been provided with a pattern in advance.

However, when the pattern wheel 1 is fixed and both the pick-up head 8 of the high-frequency proximity switch 7 and the presser 14 are caused to have relative speeds to the pattern wheel to set a pattern, no inconvenience is experienced, and it is possible to obtain a similar effect.

In the above embodiment, a solenoid is used as the driving means for pushing the jack 15. However, it is possible to use other driving means, such as an air cylinder, a pressure oil cylinder or a pulse motor, for example.

Again, in the above embodiment, it is possible to fix the means for detecting the blade of the pattern wheel and the member for pushing the jack of the pattern wheel and rotate the pattern wheel in a clockwise direction. However, this invention is not limited thereto; the pattern wheel may be rotated in a counterclockwise direction, or it is possible to fix the pattern wheel and rotate the blade detecting means of the pattern wheel and the means for pushing the jack of the pattern wheel in a clockwise or counterclockwise direction.

For pushing the jack of the pattern wheel, we have disclosed the combination of a solenoid as driving means, a presser for pushing the jack and a spring as a member for bringing back the presser after it has pushed in the jack. However, when a solenoid is used as said member for bringing back the presser after the jack has been pushed, better performance is obtained than when a spring is used.

As disclosed, the position of the detecting section of the detecting means adjacent to the pattern wheel is under the blade as shown in FIG. 4. However, it may be provided above the blade as well. The preferred position is under the blade.

As mentioned above, according to the present invention, it is possible to apply a pattern to a pattern wheel by complete automation. Moreover, the operations for applying the pattern are simple.

Again, because in the present invention the position of the blade of the pattern wheel is detected by the detecting means such as the high-frequency proximity switch, and the jack is directly pushed in setting the pattern, even when the blade of the pattern wheel is somewhat bent, or the intervals between the blades are different and not uniform, it is possible precisely to set a pattern at a high speed without committing any error.

The apparatus of the disclosed embodiment of the present invention was so used as to set a pattern at a speed of 10 jacks per second. The presser did not actuate any blade by mistake, nor was there any erroneous action.

Further, because the present invention is characterized by detecting the blades of the pattern wheel in setting a pattern, no complicated index mechanism is required. Therefore, no troublesome operation is required to apply patterns to pattern wheels having different numbers of jacks. In the conventional index mechanism, whenever the number of jacks of the pattern wheel is different, the operations of the index mechanism are re-established one after another. In contrast, the present invention can establish the operations by merely changing the position of the detecting section in each case.

Because there is no erroneous action and no necessity to correct such action in the present invention, the operational efficiency is greatly improved as compared with the conventional apparatus.

Moreover, because the detecting means of the blade of the pattern wheel of the present invention is cheaper than the conventional index mechanism, it is possible to reduce the cost of the entire apparatus drastically.

The embodiments of the invention in which an exclusive property or privilege is claimed are defined as follows:

1. In an apparatus for applying a pattern through a tape reader to a rotatable pattern wheel having a plurality of spaced-apart blades for a circular knitting machine, said blades constituting walls between which jacks are movably confined, the combination which comprises means supporting said pattern wheel, said means including a holding member, a high-frequency proximity switch for detecting the positions of the blades of said pattern wheel and for transmitting a signal, said proximity switch including a pick-up head arranged and positioned near said pattern wheel and operatively associated with said blades to detect the proximity thereof to said pick-up head, a first blade adjacent to said pick-up head, a first jack adjacent to said first blade and operative for setting the pattern of said pattern wheel, a presser connected for pushing said jack radially inwardly of the pattern wheel, means for advancing said presser to push said first jack just after the time when said first blade is detected by said proximity switch and then retracting said presser before the next successive blade is detected by said proximity switch, and means for transmitting said signal from said proximity switch through said tape reader and to said presser actuating means.

2. The apparatus as claimed in claim 1, wherein said signals are voltage pulses and said tape reader is provided with spaced characters, and means are provided for advancing said tape reader by one character for each of said voltage pulses emitted by said proximity switch.

3. The apparatus as claimed in claim 1, wherein counting means are provided for counting the number of blades of said pattern wheel.

4. The apparatus as claimed in claim 3, wherein means are provided for stopping said pattern wheel when the number of counted blades reaches a predetermined value.

5. The apparatus as claimed in claim 1, wherein said position of said pick-up head of said proximity switch near said pattern wheel is under and close to said blades of said pattern wheel.

6. The apparatus as claimed in claim 1, wherein said position of said pick-up head of said proximity switch near said pattern wheel is above and close to said blades of said pattern wheel.

7. The apparatus as claimed in claim 1, wherein said means for advancing said presser for pushing said jack of said pattern wheel is a solenoid arranged to displace said presser and said means for retracting said driving portion is a spring.

* * * * *